US006095853A

United States Patent [19]

Huang et al.

[11] Patent Number: 6,095,853

[45] Date of Patent: Aug. 1, 2000

[54] CONNECTOR ASSEMBLY

[75] Inventors: Wayne Huang, Alhambra, Calif.; Yao-Hao Chang, Chung-Ho, Taiwan; Gordon Lok, Montebello, Calif.

[73] Assignee: Hon Hai Precison Ind. Co., Ltd., Taipei Hsien, Taiwan

[21] Appl. No.: 09/000,859

[22] Filed: Dec. 30, 1997

[51] Int. Cl.[7] ..... H01R 13/60

[52] U.S. Cl. ..... 439/541.5; 439/567

[58] Field of Search ..... 439/541.5, 567, 439/607

[56] References Cited

U.S. PATENT DOCUMENTS

| | | | |
|---|---|---|---|
| 5,399,105 | 3/1995 | Kaufman et al. | 439/541.5 |
| 5,641,295 | 6/1997 | Koyama | 439/541.5 |
| 5,823,822 | 10/1998 | Tan et al. | 439/541.5 |

*Primary Examiner*—Paula Bradley
*Assistant Examiner*—Antoine Ngandjui

[57] ABSTRACT

A connector assembly includes an insulative unitary housing defining an upper section and a lower section wherein each section defines a plurality of passageways for allowing a corresponding number of contacts extending therethrough for receipt within the mating port thereof. A pair of side walls are provided on two lengthwise opposite ends of the housing wherein the upper portion of each side wall is shorter than the lower portion thereof. The upper portion defines an upper boardlock receiving region and the lower portion defines a lower boardlock receiving region whereby both of the upper boardlock and the lower boardlock have mounting legs extending downward out of the bottom surface of the housing for reaching the PC board on which the connector assembly is mounted and wherein the leg of the lower boardlock is aligned with and in front of that of the upper boardlock in a front-to-end direction. A spacer is positioned in a space defined between such pair of side walls and includes a plurality of apertures for vertical alignment of the contact tails of both the upper section and the lower section.

9 Claims, 2 Drawing Sheets

CONNECTOR ASSEMBLY

BACKGROUND OF THE INVENTION

1. Field of the Invention

The invention relates to the connector assembly, and particularly to a dual-port receptacle connector assembly for cooperation with two respective plug connectors.

2. The Related Art

The stacked type connector assembly can be referred to U.S. Pat. Nos. 4,818,239, 4,878,856, 5,336,109. Generally speaking, such stacked type connector assembly uses a separate metal or plastic bracket to reinforceably support the upper connector unit and the lower connector unit. Anyhow, in the recent years, miniaturization is the trend so that using the separate bracket is deemed not economic and unnecessary. Thus, in the invention, a unitary housing forming the upper connector unit and the lower connector unit is used to replace the aforementioned separate ones. Anyhow, using a unitary housing defining dual ports thereof is substantially different from using a pair of separate units, including how to sequentially assembling the parts thereof and how to arrange the positions of the contact tails and the plural boardlocks.

Therefore, an object of the invention is to provide a dual-port connector assembly with a unitary housing wherein the contacts and the boardlocks are arranged in a compact and neat manner for easy assembling and low cost.

SUMMARY OF THE INVENTION

According to an aspect of the invention, a connector assembly includes an insulative unitary housing defining an upper section and a lower section wherein each section defines a plurality of passageways for allowing a corresponding number of contacts extending therethrough for receipt within the mating port thereof. A pair of side walls are provided on two lengthwise opposite ends of the housing wherein the upper portion of each side wall is shorter than the lower portion thereof. The upper portion defines an upper boardlock receiving region and the lower portion defines a lower boardlock receiving region whereby both of the upper boardlock and the lower boardlock have mounting legs extending downward out of the bottom surface of the housing for reaching the PC board on which the connector assembly is mounted and wherein the leg of the lower boardlock is aligned with and in front of that of the upper boardlock in a front-to-end direction. A spacer is positioned in a space defined between such pair of side walls and includes a plurality of apertures for vertical alignment of the contact tails of both the upper section and the lower section.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
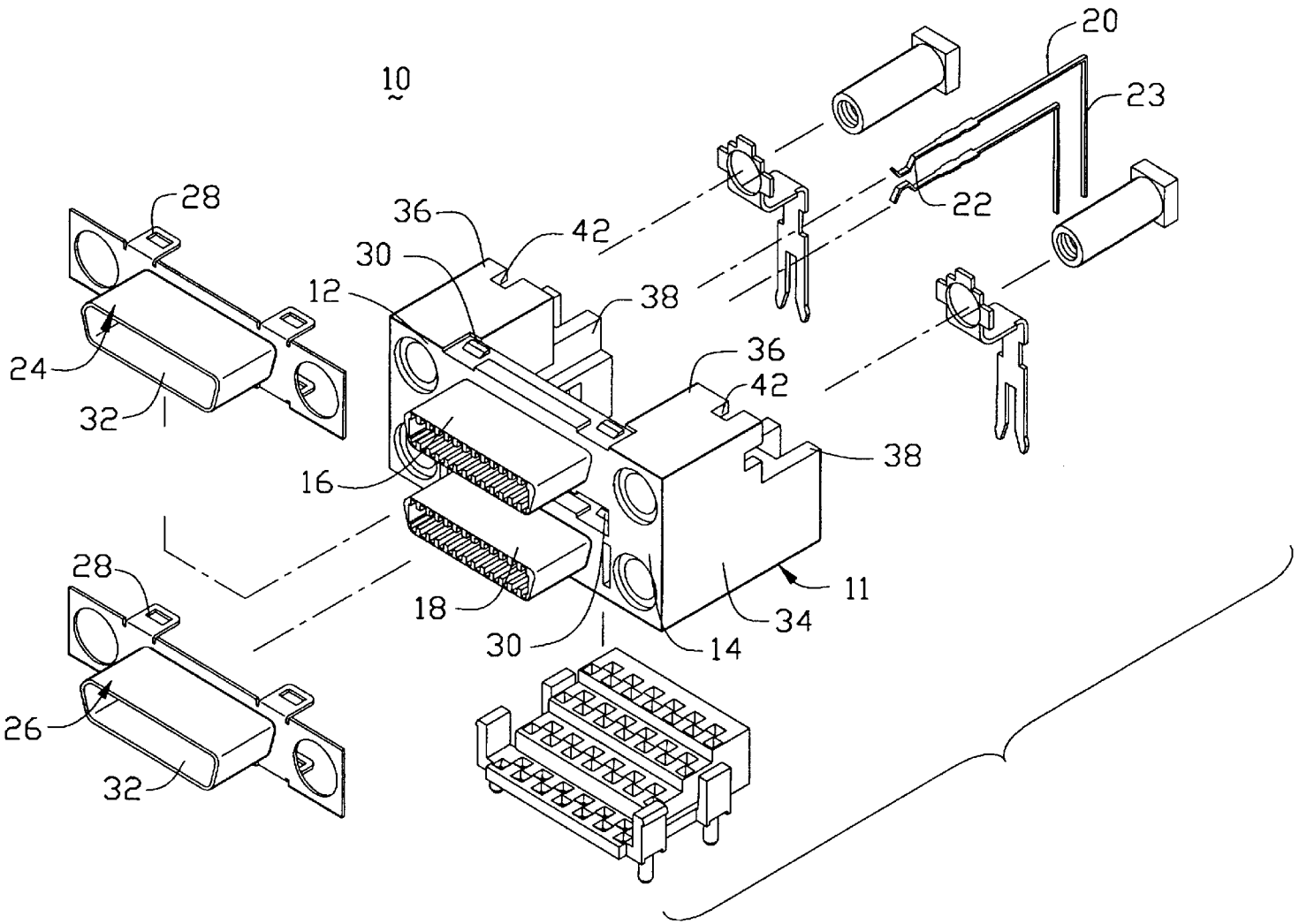
FIG. 1 is an exploded front perspective view of a presently preferred embodiment of a dual-port connector assembly without showing the lower boardlocks and corresponding nuts according to the invention.
Figure 2:
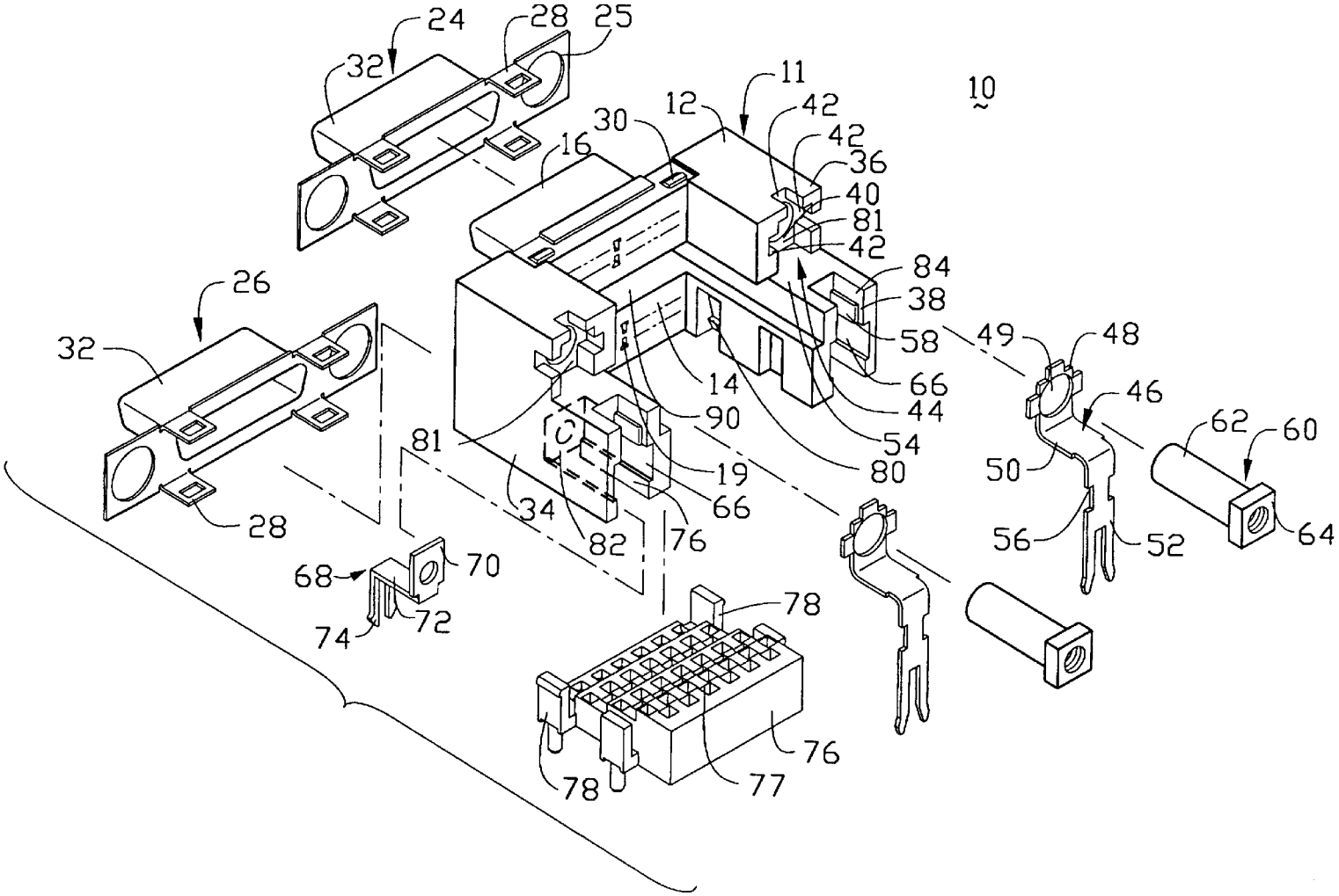
FIG. 2 is an exploded back perspective view of the dual-port connector assembly of FIG. 1 without showing the contacts and the lower boardlock nuts.

It will be noted here that for a better understanding, most of like components are designated by like reference numerals throughout the various figures in the embodiments. Attention is directed to FIGS. 1 and 2 wherein a connector assembly 10 defining an insulative housing 11, includes an upper section 12 and a lower section 14. Each upper (lower) section 12 (14) further includes a corresponding upper (lower) port 16 (18) for respectively mating with a complementary plug cable connector (not shown). Each section 12, 14 defines two rows of passageways 19 for receiving therein a corresponding number of contacts 20 wherein the forward extending contact section 22 of each contact 20 is embedded within the corresponding port 16, 18, and the rearward extending tail section 23 of the contact 20 is configured in a right angle manner for soldering to a PC board (not shown) on which the connector assembly 10 is mounted.

An upper (lower) shell 24 (26) is respectively attached to the corresponding upper (lower) section 12 (14) by means of the locking tags 28 of the shell 24, 26 engaged with the embossments on the upper (lower) section 12 (14). Each shell 24, 26 further includes a circumferential flange 32 for receiving the corresponding port 16, 18 therein.

A pair of side walls 34 are provided on two lengthwise opposite ends of the housing 11 wherein the upper portion 36 of the side wall 34, which is generally corresponding to the upper section 12, is substantially shorter than the lower portion 38 of the side wall 34, which is generally correspond to the lower section 14.

The upper portion 36 defines a square like recess 40 on the back region wherein slots 42 are formed on the corresponding surrounding faces so as to form a cross-like opening 44 thereof. An upper boardlock 46 is adapted to be assembled to the upper portion 36. The upper boardlock 46 includes a retention section 48, a supporting section 50 and a mounting leg section 52 wherein the retention section 48 has a cross-like configuration for compliance with the cross-like opening 44 of the, the supporting section 50 is seated on the middle horizontal plane 54 of the lower portion 38, and the mounting leg section 52 includes a narrowed waist 56 for engagement with the engagement bars 58 of the lower portion 38.

After the upper boardlock 46 is fully attached to the upper portion 36, a clinch nut 60 is attached to the retention section 48 from the back wherein the tubular section 62 of the nut 60 extends through the center hole 49 of the retention section 48 and fastened to the corresponding aperture 25 of the corresponding shell 24, 26. Thus, the square head 64 of the clinch nut 60 is snugly received within the recess 40 and abuts against the retention section 48 of the upper boardlock 46 for fastening the upper boardlock 46 in position, and especially for preventing backward (rearward) movement of the upper boardlock 46 with regard to the housing 11. The waist 56 of the upper boardlock 46 engages the corresponding bars 58 of the lower portion 38 for preventing the relative vertical movement of the mounting leg section 52 of the boardlock 46.

The lower portion 38 defines a horizontal recess 66 for being adapted to receive a lower boardlock 68 therein. The lower boardlock 68 includes a retention section 70 with a center hole 71 therein, a horizontal support section 72 and a mounting leg section 74. The lower portion 38 defines an elongated opening 76 along its bottom rear region for allowing both the mounting leg sections 52, 74 of the upper boardlock 46 and of the lower boardlock 68 to extend downward therethrough. Similar to the upper boardlock 46, the lower boardlock 68 is retained within the recess 66 by means of another clinch nut (not shown).

A spacer 76 defining a plurality of apertures 77 therein is provided between such pair of side walls 34 with locking tabs 78 for engagement within the corresponding grooves 80 on the inner surface of the corresponding side walls 34 for simultaneously aligning contact tails 23 of both the upper section 12 and the lower section 14 with regard to the corresponding holes in the PC board (not shown).

One feature of the invention is that the abutting vertical surface 81 for abutting against the retention section 48 of the upper boardlock 46 in the recess 40 is substantially positioned in the same vertical plane with the abutting vertical surface 82 for abutting against the retention section 70 of the lower boardlock 68, while the supporting section 50 of the upper boardlock 46 extends rearward and the supporting section 72 extends forward so that the mounting leg section 52 of the upper boardlock 46 is spaced from and aligned with the mounting leg section 74 of the lower boardlock 68 in a front-to-end direction wherein the mounting leg section 52 of the upper boardlock 46 is positioned about the rear portion of the housing 11 and the mounting leg section 74 of the lower boardlock 68 is positioned about the front portion of the housing 11.

It is also noted that the supporting section 50 of the upper boardlock 46 butts the upward facing horizontal plane 54 while the supporting section 72 of the lower boardlock 68 butts a downward facing horizontal plane (not shown). It is also seen the middle horizontal plane of the lower portion 38 defines a channel 84 for allowing the mounting leg section 52 of the upper boardlock 46 to extend downward therethrough.

It is also appreciated that the upper section 12 and the lower section 14 have a space 90 defined therebetween so that the respective shells 24, 26 can be easily assembled to the corresponding sections 12, 14.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A connector assembly including:

an insulative housing defining an upper section and a lower section;

each of said upper section and lower section including a mating port and defining a plurality of passageways;

a plurality of contacts received within said corresponding passageways therein;

a pair of side walls positioned at two lengthwise opposite ends of the housing;

each of said side walls including an upper portion and a lower portion;

said upper portion defining an upper recess to fasten an upper boardlock thereto and said lower portion defining a lower recess to fasten a lower boardlock thereto;

each of said upper boardlock and said lower boardlock including a retention section, a supporting section and a mounting leg section wherein the mounting section of the upper boardlock is spaced from and aligned with the mounting section of the lower boardlock in a front-to-end direction and wherein said retention section of the upper boardlock is generally aligned with the retention section of the lower boardlock in a same vertical plane.

2. The connector assembly as defined in claim 1, wherein the supporting section of the upper boardlock extends rearward and the supporting section of the lower boardlock extends forward.

3. The connector assembly as defined in claim 1, wherein said supporting section of the upper boardlock butts an upward facing horizontal plane and the supporting section of the lower boardlock butts a downward facing horizontal plane.

4. A connector assembly including an unitary housing defining an upper section and a lower section respectively comprising mating ports thereof, a plurality of contacts extending through the corresponding upper section and lower section, a pair of side walls respectively positioned at two lengthwise opposite ends of the housing wherein each of said side walls comprises an upper portion and a lower portion to respectively receive an upper boardlock and a lower boardlock wherein the upper portion is shorter than the lower portion in a front-to-end direction and wherein each of said upper boardlock and said lower boardlock has a vertical mounting leg section, and the mounting leg section of the upper boardlock extends through the lower portion and is aligned with and spaced from the mounting section of the lower boardlock in said front-to-end direction.

5. The connector assembly as defined in claim 4, wherein said mounting leg section of the upper boardlock is positioned about a rear portion of the housing and the mounting leg section of the lower boardlock is positioned about a front portion of the housing.

6. The connector assembly as defined in claim 4, wherein each of the upper portion and the lower portion has a horizontal recess for receiving the retention section of the corresponding boardlock whereby said retention section of the boardlock can assembled into the corresponding recess from the back.

7. A connector assembly including an insulative housing defining at least a mating port with a plurality of contacts thereof, a pair of side walls positioned at two lengthwise opposite ends and forming a recess therein for attaching at least a boardlock thereto, said boardlock including at least a mounting leg section and a retention section wherein the retention section has a cross-like shape for compliance with a similar cross-like opening in the side wall.

8. A connector assembly including an unitary housing defining an upper section and a lower section each comprising a mating port thereof, a plurality of contacts extending through the corresponding upper section and lower section, a pair of side walls respectively positioned at two lengthwise opposite ends of the housing wherein each of said side walls comprises an upper portion and the lower portion to respectively receive therein an upper boardlock and a lower boardlock, said lower portion defining an elongated opening wherein each of said upper boardlock and said lower boardlock has a vertical mounting leg section, and both the mounting leg section of the upper boardlock and the mounting leg section of the lower boardlock extend through said elongated opening of the lower portion and are aligned with and spaced from each other in a front-to-end direction.

9. A connector assembly including:

an insulative defining an upper section and a lower section;

each of said upper section and lower section including a mating port and defining a plurality of passageways;

a plurality of contacts received within said corresponding passageways therein;

a pair of side walls positioned at two lengthwise opposite ends of the housing;

each of said side walls including an upper portion and a lower portion;

said upper portion defining fastening an upper boardlock thereto and said lower portion fastening a lower boardlock thereto;

each of said upper boardlock and said lower boardlock including a retention section, a supporting section and a mounting leg section wherein the mounting section of the upper boardlock is spaced from and aligned with the mounting section of the lower boardlock in a front-to-end direction and wherein the supporting section of the upper boardlock extends rearward and the supporting section of the lower boardlock extends forward.

* * * * *